US008724841B2

(12) United States Patent
Bright et al.

(10) Patent No.: US 8,724,841 B2
(45) Date of Patent: May 13, 2014

(54) MICROPHONE WITH ACOUSTIC MESH TO PROTECT AGAINST SUDDEN ACOUSTIC SHOCK

(71) Applicant: Apple Inc., Cupertino, CA (US)

(72) Inventors: Andrew P. Bright, San Francisco, CA (US); Christopher R. Wilk, Sunnyvale, CA (US); Jae Han Lee, San Jose, CA (US); Ruchir M. Dave, San Jose, CA (US); Scott P. Porter, Cupertino, CA (US); Sawyer Isaac Cohen, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/660,650

(22) Filed: Oct. 25, 2012

(65) Prior Publication Data

US 2014/0064542 A1 Mar. 6, 2014

Related U.S. Application Data

(60) Provisional application No. 61/695,250, filed on Aug. 30, 2012.

(51) Int. Cl.

| | |
|---|---|
| ***H04R 1/02*** | (2006.01) |
| *H04R 1/20* | (2006.01) |
| *E04B 1/82* | (2006.01) |

(52) U.S. Cl.
USPC ..... 381/359; 381/354; 381/346; 181/284

(58) Field of Classification Search
USPC ..... 381/354, 359, 189; 455/575.1, 575.3, 455/575.4, 575.8
See application file for complete search history.

(56) References Cited

U.S. PATENT DOCUMENTS

| | | | | |
|---|---|---|---|---|
| 5,828,012 | A | 10/1998 | Repollé et al. | |
| 6,442,194 | B1 | 8/2002 | Yasuno et al. | |
| 6,512,834 | B1 | 1/2003 | Banter et al. | |
| 7,110,536 | B2 | 9/2006 | Hampton et al. | |
| 7,218,745 | B2 * | 5/2007 | McConnell et al. | 381/302 |
| 7,991,173 | B2 | 8/2011 | Ueki | |
| 2003/0063762 | A1 | 4/2003 | Tajima et al. | |
| 2009/0245565 | A1 * | 10/2009 | Mittleman et al. | 381/365 |
| 2009/0247244 | A1 | 10/2009 | Mittleman et al. | |

(Continued)

FOREIGN PATENT DOCUMENTS

| | | | |
|---|---|---|---|
| WO | WO 94/06256 | A1 | 3/1994 |
| WO | WO 2011/076289 | A1 | 6/2011 |

OTHER PUBLICATIONS

PCT International Search Report for PCT/US2013/051898, mailed Sep. 11, 2013.

*Primary Examiner* — Brian Ensey
*Assistant Examiner* — Norman Yu
(74) *Attorney, Agent, or Firm* — Blakely, Sokoloff, Taylor & Zafman LLP

(57) ABSTRACT

A portable electronic device having an outer case having a substantially planar face in which a microphone associated acoustic port is formed. The device also has a micro-electro-mechanical system (MEMS) microphone positioned within the outer case, the MEMS microphone having a diaphragm facing the microphone associated acoustic port. An acoustic mesh is positioned between the front face of the outer case and the diaphragm, the acoustic mesh having a non-linear acoustic resistance so as to minimize an effect of an incoming air burst on the diaphragm. Other embodiments are also described and claimed.

19 Claims, 7 Drawing Sheets

(56) References Cited

U.S. PATENT DOCUMENTS

| | | | | |
|---|---|---|---|---|
| 2010/0119097 | A1 | 5/2010 | Ohtsuka | |
| 2011/0143114 | A1 | 6/2011 | Horie et al. | |
| 2011/0255728 | A1 | 10/2011 | Abe et al. | |
| 2011/0261986 | A1 | 10/2011 | Murayama | |
| 2012/0076321 | A1 | 3/2012 | Ring et al. | |
| 2012/0177237 | A1* | 7/2012 | Shukla et al. | 381/332 |
| 2013/0032285 | A1* | 2/2013 | Mietta et al. | 156/250 |

* cited by examiner

MICROPHONE WITH ACOUSTIC MESH TO PROTECT AGAINST SUDDEN ACOUSTIC SHOCK

CROSS-REFERENCE TO RELATED APPLICATIONS

The application claims the benefit of the earlier filing date of U.S. Provisional Patent Application No. 61/695,250, filed Aug. 30, 2012 and incorporated herein by reference.

FIELD

An embodiment of the invention is directed to a transducer having an acoustic mesh to protect against acoustic shock, more specifically a microphone with acoustic mesh to protect against a sudden air burst. Other embodiments are also described and claimed.

BACKGROUND

Cellular telephone handsets and smart phone handsets have within them a microphone that converts input sound pressure waves produced by the user speaking into the handset, into an output electrical audio signal. The handset typically has a housing with an opening through which incoming sound pressure waves created by the user's voice can reach the microphone. This opening, however, can also allow for entry of rapid air bursts when, for example, the phone unintentionally and forcefully collides with a flat surface or a user tries to clean the device with a high pressure air flow. If these rapid air bursts reach the microphone, the transducer experiences a sudden acoustic shock that can damage the flexible diaphragm and rigid back plate found within the microphone, which is not designed to withstand such a force.

SUMMARY

An embodiment of the invention is a personal portable electronic device having an outer case with at least one substantially planar face in which an acoustic port associated with a transducer (that is to be installed inside the outer case of the device) is formed. In some embodiments, the transducer may be a microphone, such as a micro-electro-mechanical systems (MEMS) microphone. The MEMS microphone may include various components, for example a pressure sensitive diaphragm, which are sensitive to a sudden acoustic shock, such as one that may be directed into the case through the acoustic port when the device experiences a sudden, forceful collision with a flat surface on the planar face having the acoustic port. In this aspect, the invention further includes an acoustic mesh positioned between the substantially planar face of the outer case and the diaphragm, and that covers the acoustic port. The acoustic mesh may have a non-linear acoustic resistance so as to minimize an effect of a sudden acoustic shock, such as an incoming air burst, on the MEMS microphone. For example, the acoustic mesh may decrease the pressure from the air burst passing through the acoustic mesh in a non-linear manner in order to prevent damage to the diaphragm.

In some embodiments, the acoustic mesh may be a closed mesh material having a relatively high specific and/or absolute acoustic resistance. For example, the acoustic mesh may have a specific acoustic resistance of at least 350 MKS rayls, more preferably at least 1000 MKS rayls, or at least 1800 MKS rayls. Such a closed mesh material may, for example, be woven to have substantially no calculable openings on its face side. In other embodiments, the acoustic mesh may be any type of mesh material having a non-linear acoustic response to an incoming air burst as described herein, for example, a closed mesh material.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

Figure 1A:
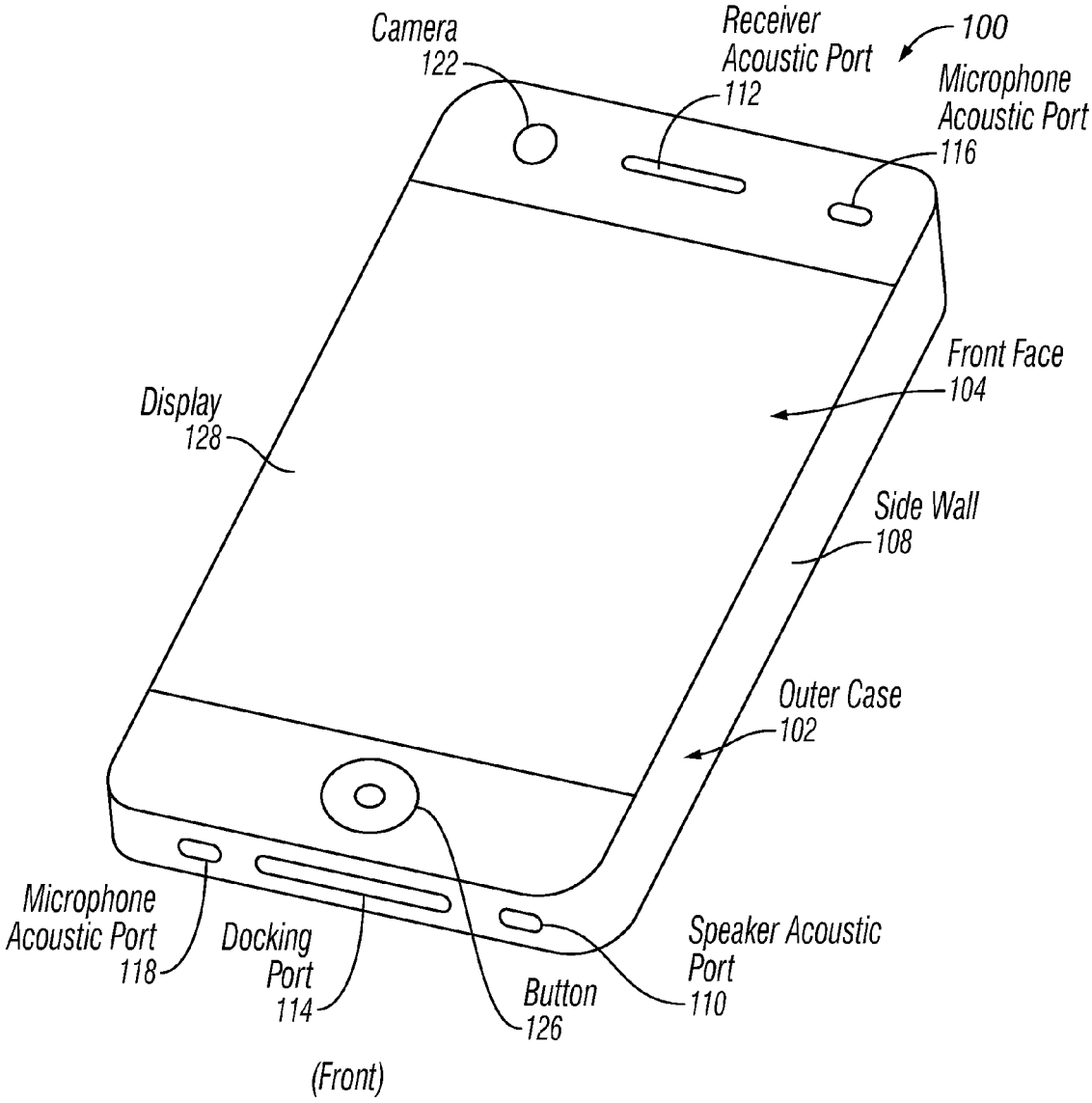
FIG. 1A illustrates a front perspective view of one embodiment of a mobile communications device.
Figure 1B:
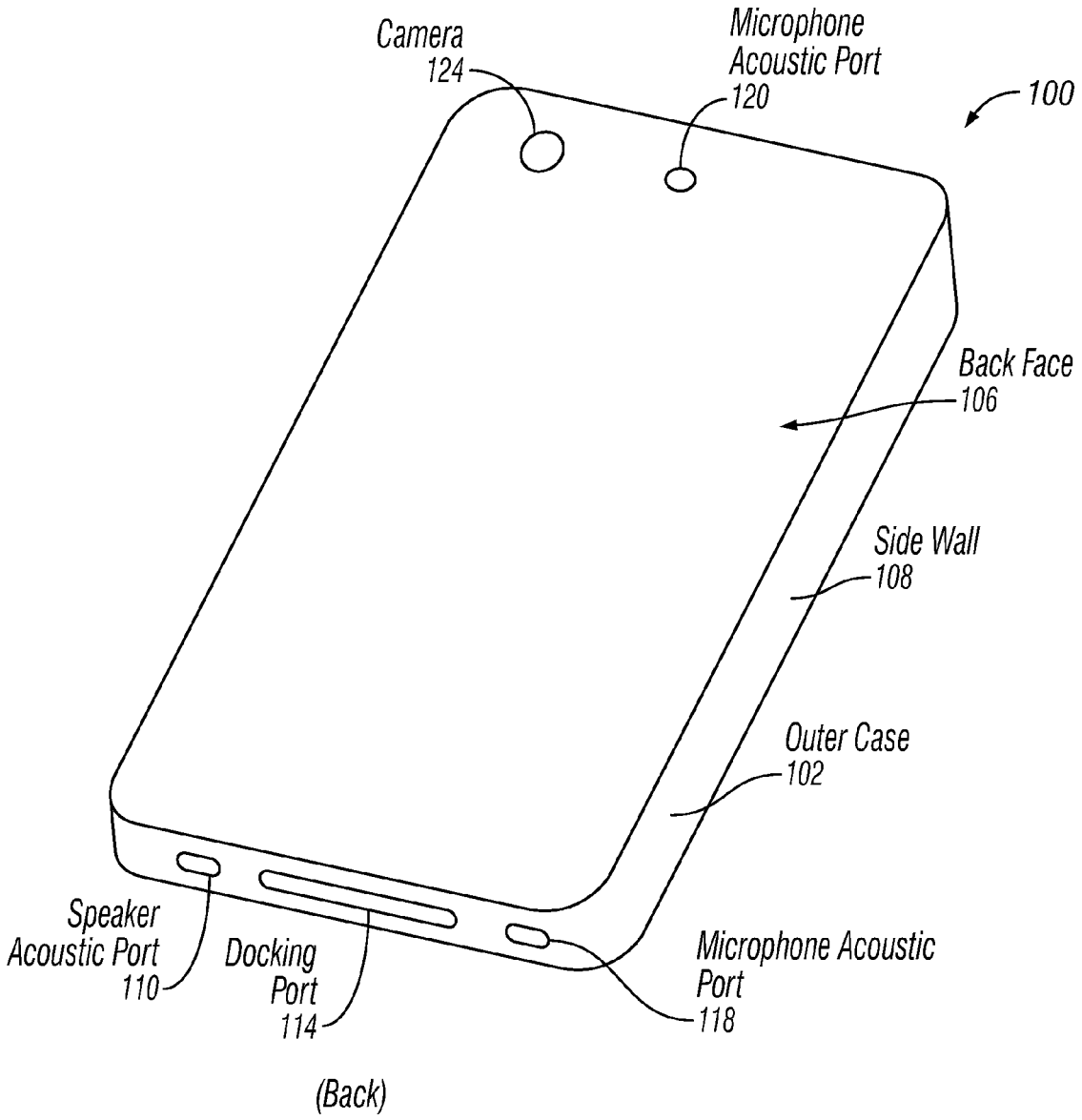
FIG. 1B illustrates a back perspective view of one embodiment of a mobile communications device.

FIG. 1A and FIG. 1B illustrate front and back perspective views of a mobile communications device 100 (also referred to as a wireless or mobile telephone). Further details of the device 100 are given below in connection with the description of FIG. 5 and FIG. 6. For now, it should be appreciated that device 100 has an outer housing or case 102 defining or closing off a chamber in which the constituent electronic components of the device 100 are housed. Outer case 102 includes a substantially planar front face 104 and a substantially planar rear face 106, which are connected by a sidewall portion 108. The front face 104 may be considered a display side of the device in that it may include a touch screen display 128 that serves as an input and a display output for the device. The touch screen display 128 may be a touch sensor (e.g., those used in a typical touch screen display such as found in an iPhone® device by Apple Inc.). Although the touch screen is illustrated on front face 104, if desired, it may be mounted on the back face 106 of device 100, on a side wall 108 of device 100, on a flip-up portion of device 100 that is attached to a main body portion of device 100 by a hinge (for example), or using any other suitable mounting arrangement. The rear face 106 may form a back side of the device, which can be held by the user during operation of device 100.

To further enable its use as a mobile communications device, device 100 may include various acoustic openings or ports at different locations within outer case 102 to allow for transmission of acoustic signals to and from device 100. Representatively, outer case 102 may have formed therein a speaker acoustic port 110, a receiver acoustic port 112 and microphone acoustic ports 116, 118, 120. Although the acoustic ports are illustrated as separate ports, it is contemplated that any one or more of the illustrated ports may be combined into one port such that, for example, the transducers associated with the illustrated receiver or microphone ports may instead share the same port. In one embodiment, the receiver acoustic port 112 is formed within front face 104 of outer case 102 and speaker acoustic port 110 is formed within an end portion of sidewall 108. It is contemplated, however, that each of these ports may be formed in other portions of outer case 102, for example, speaker acoustic port 110 may be on the front face 104 or back face 106 while receiver acoustic port 110 is along the sidewall. Each of these ports may consist of multiple holes clustered together or alternatively a single, large hole as shown.

Microphone acoustic ports 116, 118 and 120 may be formed along the front face 104, back face 106 and sidewall 108 of outer case 102 as illustrated. Representatively, in one embodiment, microphone acoustic port 116 is formed in front face 104 while microphone acoustic port 120 is formed in back face 106. Microphone acoustic port 118 may be formed within a bottom portion of sidewall 108. Although FIG. 1A and FIG. 1B illustrate a single microphone acoustic port formed within each of the above described portions of outer case 102, it is contemplated that more than one microphone acoustic port may be formed in one or more of these portions. For example, two microphone acoustic ports may be formed along front face 104 or back face 106.

Each of the speaker acoustic port 110, receiver acoustic port 112 and microphone acoustic ports 116, 118 and 120 may be associated with one or more transducers, which are mounted within outer case 102. In the case of the microphone acoustic ports 116, 118 and 120, the transducer is an acoustic-to-electric transducer such as a microphone that converts sound into an electrical signal. The microphone may be any type of microphone capable of receiving acoustic energy, for example sound through the associated port, and converting it into an electrical signal. For example, in one embodiment, the microphone may be a micro-electro-mechanical systems (MEMS) microphone, also referred to as a microphone chip or silicon microphone. In this aspect, various features of the microphone such as the pressure-sensitive diaphragm, are etched directly into a silicon chip by MEMS techniques.

The MEMS microphone components, including the pressure-sensitive diaphragm, while sensitive to acoustic pressures, may also be sensitive to sudden acoustic shocks such as high pressure, impulsive air bursts. Such an air burst may occur when, for example, device 100 collides forcefully with a substantially flat surface or a user tries to clean the device with a compressed air duster. A pressure from such an air burst is particularly problematic with respect to microphones associated with ports on the substantially planar faces (e.g. front face 104 and back face 106) of device 100. For example, when device 100 experiences a collision with a flat surface on front face 104 or back face 106, the air pressure builds up as the device meets the surface with which it is colliding and cannot easily escape around the sides of device 100. Some of the air is therefore forced into the ports, such as microphone acoustic port 116 or microphone acoustic port 120, depending upon which face of device 100 impacts the surface. This rapid burst of air can, in turn, rapidly increase a pressure and/or air flow on the associated diaphragm and damage the diaphragm, and/or other components within the MEMS microphone. It is noted that the terms "air burst," "rapid air burst" and "impulsive air burst" may be used interchangeably herein and should be understood as referring to a type of sudden acoustic shock caused by a burst of air which occurs suddenly and has a particle velocity sufficient to damage an unprotected transducer diaphragm. Thus, an "air burst" should be understood as having both a pressure and a particle velocity higher than, for example, that which would be produced by a user speaking into the device.

In order to protect the MEMS microphone, particularly the diaphragm, from such air bursts, an acoustic mesh having a non-linear acoustic resistance may be positioned between the diaphragm and the associated acoustic port within the device outer casing as will be described in more detail in reference to FIG. 2, FIG. 3 and FIG. 4.

Cameras 122, 124 may further be mounted to outer case 102 to capture still and/or video images of objects of interest. In the illustrated embodiment, cameras 122, 124 are mounted along the front face 104 and back face 106 of outer case 102, respectively. It is contemplated, however, that in some embodiments, cameras 122, 124 may be mounted along the same side or face of outer case 102, or one of cameras 122, 124 may be omitted such that a camera is mounted on only one side of outer case 102.

The outer case 102 may further include other input-output devices such as an earphone port (not shown) to receive an earphone plug, docking port 114 and command button 126. Docking port 114 may sometimes be referred to as a dock connector, 30-pin data port connector, input-output port, or bus connector, and may be used as an input-output port (e.g., when connecting device 100 to a mating dock connected to a computer or other electronic device). Command button 126 may be, for example, a menu button or any other device that can be used to supply an input to and/or operate device 100.

Figure 2:
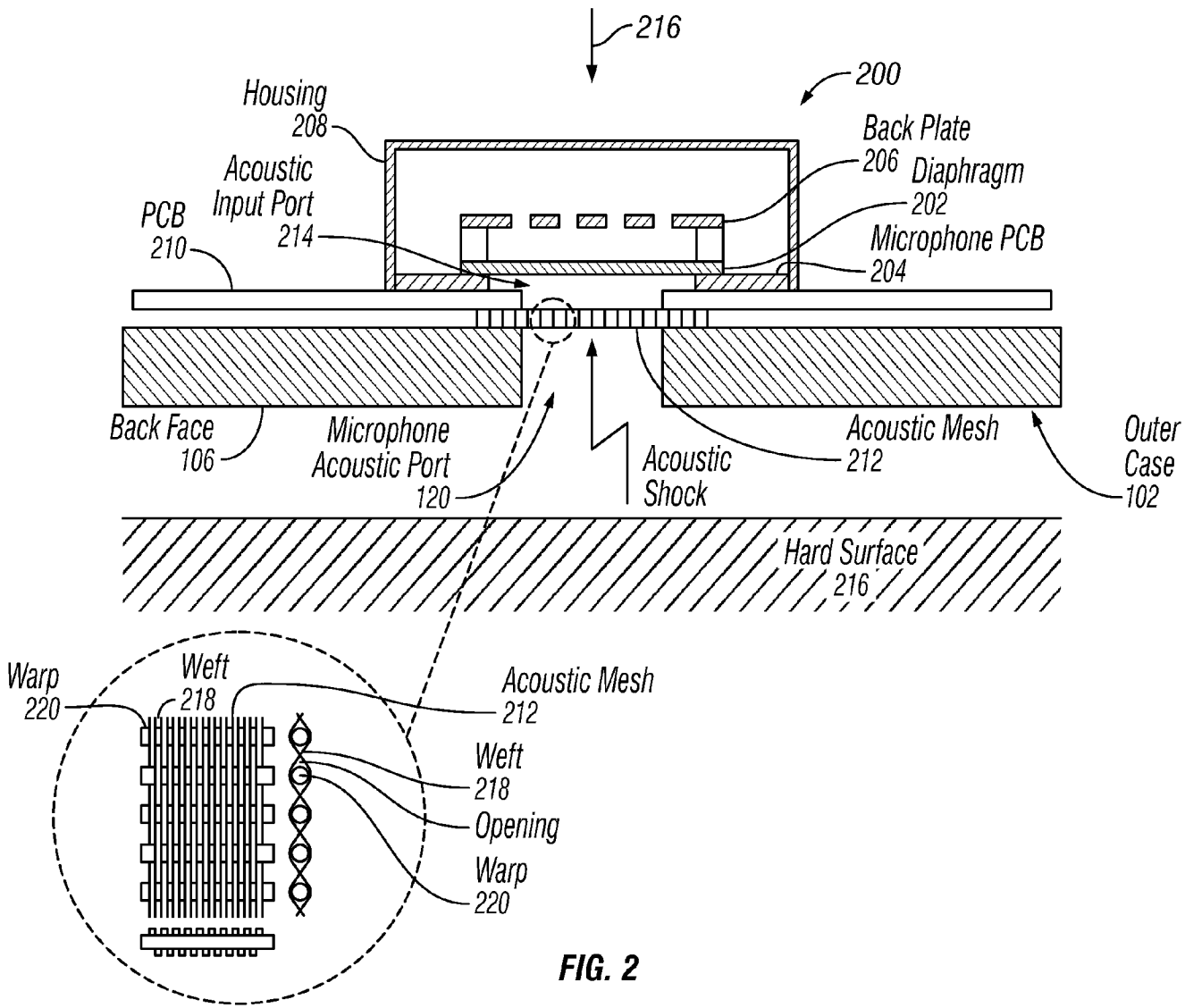
FIG. 2 illustrates a cross sectional side view of one embodiment of a microphone assembly having an acoustic mesh to protect against sudden acoustic shock.

Referring now to FIG. 2, FIG. 2 illustrates a cross sectional side view of one embodiment of a MEMS transducer having an acoustic mesh over the diaphragm to protect the diaphragm from a rapid air burst. In one embodiment, the transducer may be a MEMS microphone 200. MEMS microphone 200 may be a digital microphone having a built in analog-to-digital converter (ADC) circuit. MEMS microphone 200 may have diaphragm 202 which is etched into a silicon chip used to form MEMS microphone 200. Diaphragm 202 may be positioned between a microphone PCB 204 and a back plate 206 of the MEMS structure, or the position of the diaphragm and backplate may be reversed. Diaphragm 202 may be etched directly into a silicon chip by any suitable MEMS fabrication technique, and accompanied with an integrated preamplifier (not shown). The back plate 206 may include electrical components (e.g. electrodes) which can be used to provide electric connections between MEMS microphone 200 and the device in which it is mounted (e.g. device 100). Microphone PCB 204 may be used to mount MEMS microphone 200 to a system PCB substrate 210 mounted to the back face 106 of outer case 102.

In the illustrated embodiment, MEMS microphone 200 is a bottom ported device meaning that the acoustic input port 214 is at a bottom side of the device. In other words, acoustic input port 214 is below diaphragm 202 in the illustrated embodiment. It is contemplated, however, that a top ported microphone (e.g. having a port through housing 208) may also be used if desired. MEMS microphone 200 may further include a housing 208 which contains each of the MEMS microphone components and may be used to tune acoustic characteristics of MEMS microphone 200, such as by changing its size.

As can be seen from the illustrated embodiment, the acoustic input port 214 of MEMS microphone 200 is aligned with, and acoustically coupled to, microphone acoustic port 120. As previously discussed in reference to FIG. 1B, acoustic port 120 may be formed within back face 106. It is contemplated, however, that MEMS microphone 200 may be aligned with and acoustically coupled to any of microphone acoustic ports 116, 118, 120. In the case where MEMS microphone 200 is aligned with an acoustic port on a substantially planar face of device 100 (e.g. front face 104 or back face 106), diaphragm 202 is susceptible to damage due to a rapid air burst. For example, if device outer case 102 is impacted in a direction of arrow 216 such that back face 106 contacts a hard surface 216, a rapid air burst may be generated and flow through microphone acoustic port 120 in a direction of diaphragm 202, which faces microphone acoustic port 120. If this air burst propagates to diaphragm 202 with substantially unmodified velocity and pressure, it may damage diaphragm 202, and/or other components within MEMS microphone 202. Although in the illustrated embodiment, diaphragm 202 faces the port, it is contemplated that a diaphragm or microphone component which does not directly face the port may also be susceptible to damage, such as may be the case where the microphone is offset from the port and acoustically coupled to the port by a duct or in the case of a top ported MEMS microphone.

To prevent such damage, acoustic mesh 212 may be positioned between diaphragm 202 and outer case 102. Acoustic mesh 212 may be of a size and shape sufficient to cover microphone acoustic port 120. In one embodiment, acoustic mesh 212 may cover the entire port 120. Alternatively, acoustic mesh 212 may cover less than the entire port 120. Acoustic mesh 212 may be a single piece of material having an area large enough to cover the desired port (e.g. microphone acoustic port 120) or a composite of materials combined together. Acoustic mesh 212 may be secured in place by attaching it to a portion of microphone 200 (e.g. base portion 204) and/or outer case 102 (e.g. an inner surface of back face 106). For example, acoustic mesh 212 may be attached to base portion 204 or outer case 102 using an adhesive, such as a pressure sensitive adhesive film, chemical bonding, or the like. Although two specific attachment locations are described, it is contemplated that acoustic mesh 212 may be attached to any portion of device 100 next to the desired port and in any suitable manner. For example, acoustic mesh 212 may be held in place by a frictional arrangement in which acoustic mesh 212 is pressed or sandwiched between outer case 102 and base portion 204 by pressing the two portions together.

Acoustic mesh 212 may be formed from a mesh material having a non-linear acoustic response to an acoustic shock such as an air burst. In other words, at slower airspeeds, such as sound waves from a user's voice or speech, acoustic mesh 212 behaves substantially linearly, while at extreme speeds such as air bursts, the acoustic mesh 212 behaves non-linearly thus providing greater protection to the associated transducer. The non-linear acoustic response may be achieved by selecting a material having a relatively high acoustic resistance and/or tuning a dimension of the associated acoustic port the material is designed to cover in order to increase an acoustic resistance across the material. Acoustic mesh 202 can therefore reduce an effect of an incoming air burst on the transducer in a non-linear manner and present a linear acoustic resistance to speech by a user of the device.

Figure 3:
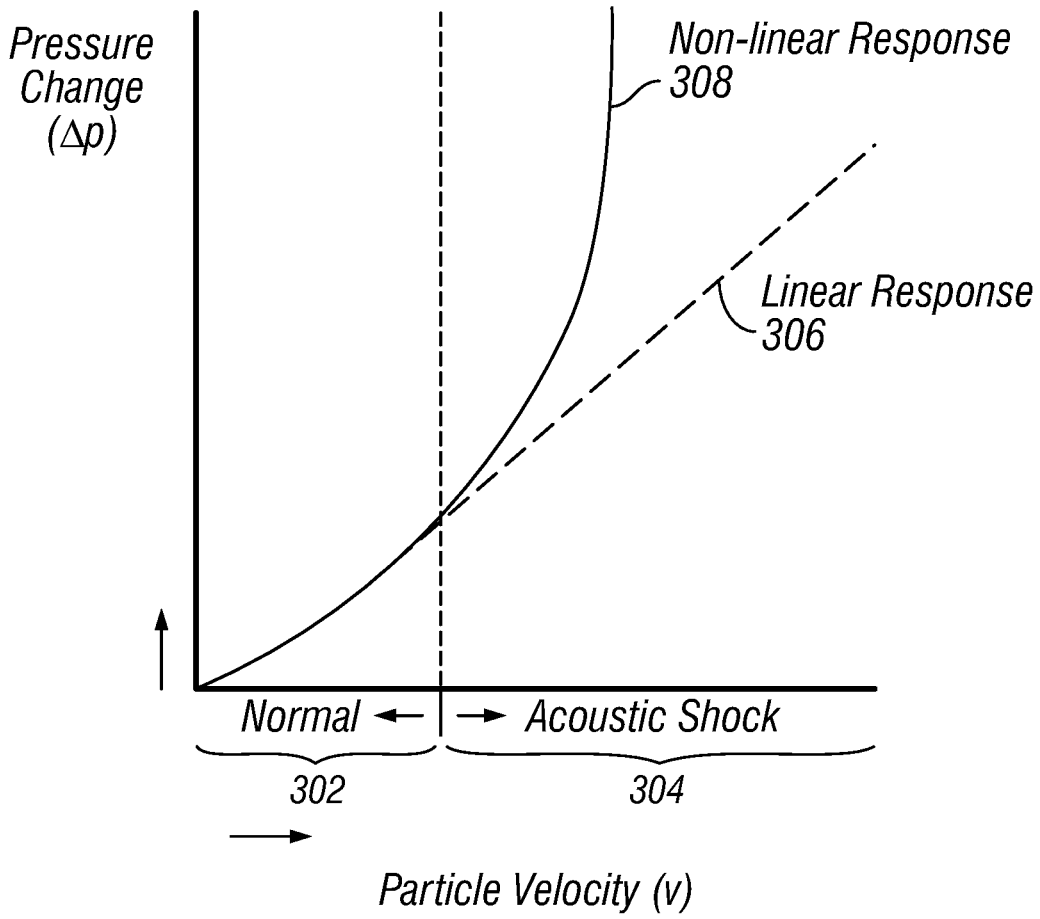
FIG. 3 illustrates a non-linear response of an acoustic mesh for protecting against sudden acoustic shock.

The relationship between the non-linear acoustic response and the acoustic resistance may be better illustrated by referring to the following formulas and FIG. 3. In particular, the acoustic resistance of the material itself, not taking into account its area, may be referred to herein as the specific acoustic resistance. The specific acoustic resistance ($r_s$) may be defined as the pressure difference across the mesh ($\Delta p$) divided by the particle velocity (v) as illustrated by the following Formula I:

$$r_s=\Delta p/v \rightarrow /\text{Pa}\cdot\text{s/m}] \rightarrow [\text{MKS rayls}]$$

where acoustic resistance is identified as $r_s$, the pressure difference across the mesh is identified by $\Delta p$ and particle velocity corresponds to v.

The acoustic resistance may also be calculated by taking into account the mesh area through which the air flows, in other words the port size. This is referred to herein as an absolute acoustic resistance. The absolute acoustic resistance may be determined by dividing the specific acoustic resistance by the mesh area exposed to the acoustic waves (aperture area) as illustrated by the following Formula II:

$$R_{acs}=r_s/A \rightarrow [\text{Pa}\cdot\text{s/m}^3]$$

where absolute acoustic resistance is identified as $R_{acs}$ and the ensonified mesh area is A.

The acoustic resistance can be affected by both the mesh material properties and the mesh area exposed to the acoustic shock. Thus, in addition to selecting a material having a desired acoustic resistance, the aperture size can be used to fine tune the acoustic resistance as will be described in more detail below.

With these calculations in mind, FIG. 3 illustrates the effect the linearity of the acoustic response has on the acoustic resistance. In particular, it can be understood from this illustration that when the particle velocity (v), which is on the x-axis, is within a normal range 302 (e.g., when a user is speaking into the device), the material (e.g. acoustic mesh 212) has a substantially linear acoustic response 306. In other words, the pressure difference ($\Delta p$) across the material, which is on the y-axis, is substantially proportional to the change in particle velocity. When the particle velocity, however, increases to a range considered to be an acoustic shock 304 (e.g., when a face of the device having the mesh covered port is dropped on a flat surface), the change in pressure occurs to a much greater degree than the change in particle velocity resulting in a non-linear acoustic response 308. In other words, acoustic mesh 212 creates a pressure drop across the mesh to a greater degree in response to an air burst than air flow within a normal range. This in turn, allows for minimal effect on transducer operation at normal air speeds while protecting the transducer at higher air speeds.

With the contribution from the non-linear acoustic response, a significant pressure drop can be achieved in acoustic applications by using a mesh material having a significantly higher specific acoustic resistance than meshes typically found in acoustic applications. For example, in one embodiment, acoustic mesh 212 may be a mesh material having an acoustic resistance of greater than 350 MKS rayls. More specifically, acoustic mesh 212 may have an acoustic resistance of from about 350 MKS rayls to about 5000 MKS rayls, for example, from about 1000 rayls to about 3000 MKS rayls, representatively from 1500 MKS rayls to 1800 MKS rayls.

The acoustic response may further be tuned by modifying the exposed area of the material, in other words a size of the associated port such as microphone acoustic port 120 illustrated in FIG. 2. For example, decreasing the exposed mesh area in port 120 will increase the absolute acoustic resistance of the device. Representatively, the port may have a size sufficient to achieve an absolute acoustic resistance from about $10^8$ [Pa·s/m$^3$] to about $10^{10}$ [Pa·s/m$^3$], for example, from about $1\times10^9$ [Pa·s/m$^3$] to about $5\times10^9$ [Pa·s/m$^3$], representatively, from 600 MKS rayls to 2000 MKS rayls.

It is noted that in some cases acoustic mesh 212 may help to tune the high frequency response of the device. In particular, it has been recognized that some MEMS microphones may be more sensitive to high frequency sound waves than other types of microphones, such as electret condenser microphones. Thus, MEMS microphones may have a peak around the 10-20 KHz range of the frequency response curve. Materials having a relatively high acoustic resistance, such as within the above described ranges, can significantly filter out some of these high frequency sound waves in some cases creating a more desirable (e.g. more flat or less peaky) frequency response for the microphone without electronic compensation (as installed in the device and covered with the mesh), at least at a band above 1 kHz. It is to be further understood, that any effects acoustic mesh 212 may have on an acoustic performance of device 100, whether desirable or undesirable, may be partially or wholly compensated for by electrically tuning device 100 to achieve the desired acoustic response. For example, where filtering of some of the previously discussed high frequency sound waves is undesirable, device 100 can be electrically tuned to off-set the effect of mesh 212 on the high frequency performance. However, in some cases, this electrical tuning may create a non-negligible boost of the self-noise of the microphone therefore in some embodiments, the value of the acoustic mesh resistance can be adjusted to take this into account.

In one embodiment, acoustic mesh 212 may be a mesh material having a straight weave. For example, acoustic mesh 212 may be a closed mesh material. The mesh material may be formed by weaving one or more strands of yarn through a series of "in tension" yarns, which are held in tension on a loom. Typically, the woven yarns are referred to as "weft" yarns while the "in tension" yarns are referred to as "warp" yarns. As can be seen from the magnified view of FIG. 2, which illustrates acoustic mesh 212 having a closed mesh material, the weft yarns 218 lie as close as possible together such that substantially no "open area" between the warp yarns 220 and weft yarns 218 can be calculated on the material face side. In this aspect, acoustic mesh 212 can be considered to have substantially no mesh openings on the face side. The only "openings" that may be present, are triangular openings 222 which appear when diagonally viewing the weave. FIG. 2 illustrates a closed mesh weave sometimes referred to as a reverse dutch weave or tressen weaver. It is contemplated, however, that a plain dutch weave (in which the warp and weft yarns are interchanged), or any other type of weave capable of forming a closed mesh material may be used to form acoustic mesh 212. In some embodiments, in addition to protecting the device from acoustic shock, acoustic mesh 212 may further protect the internal components of device 100 (e.g. microphone 200) from contaminants (e.g. dust and particles).

In one embodiment, the mesh may be woven from a yarn or fiber made of any material suitable for forming an acoustic mesh having the properties described herein. Representative suitable materials may include, but are not limited to, polyurethane, polyester, nylon, acrylic, polypropylene and rayon. The mesh may be woven from one of the above-referenced materials, or a combination of different materials. For example, the weft yarn may be of a different material than the warp yarn.

Although a closed mesh material is described, it is further contemplated that acoustic mesh 212 may be any material having a non-linear acoustic response, and more specifically, an acoustic resistance within the above described ranges. For example, in one embodiment, acoustic mesh 212 may be an open mesh material having openings small enough to achieve a specific acoustic resistance or absolute acoustic resistance within the above-described ranges. In another embodiment, acoustic mesh 212 can be replaced with a protection layer that restricts air flow as previously discussed. Suitable membranes may include, but are not limited to, a microporous, mesoporous or macroporous film made of any material suitable for acoustic applications.

Still further, although not illustrated in FIG. 2, it is contemplated that a cosmetic mesh or grill having a visually appealing look but no significant acoustic characteristics, i.e. an acoustically transparent material, may also be positioned over acoustic input port 214 and/or microphone acoustic port 120. The cosmetic mesh may serve to protect the device from contaminants and/or provide the user with a visual indicator of the location of the microphone port so that the user will know which part of the device to speak at or aim at audio signals the user desires to be picked up by the associated microphone.

Figure 4:
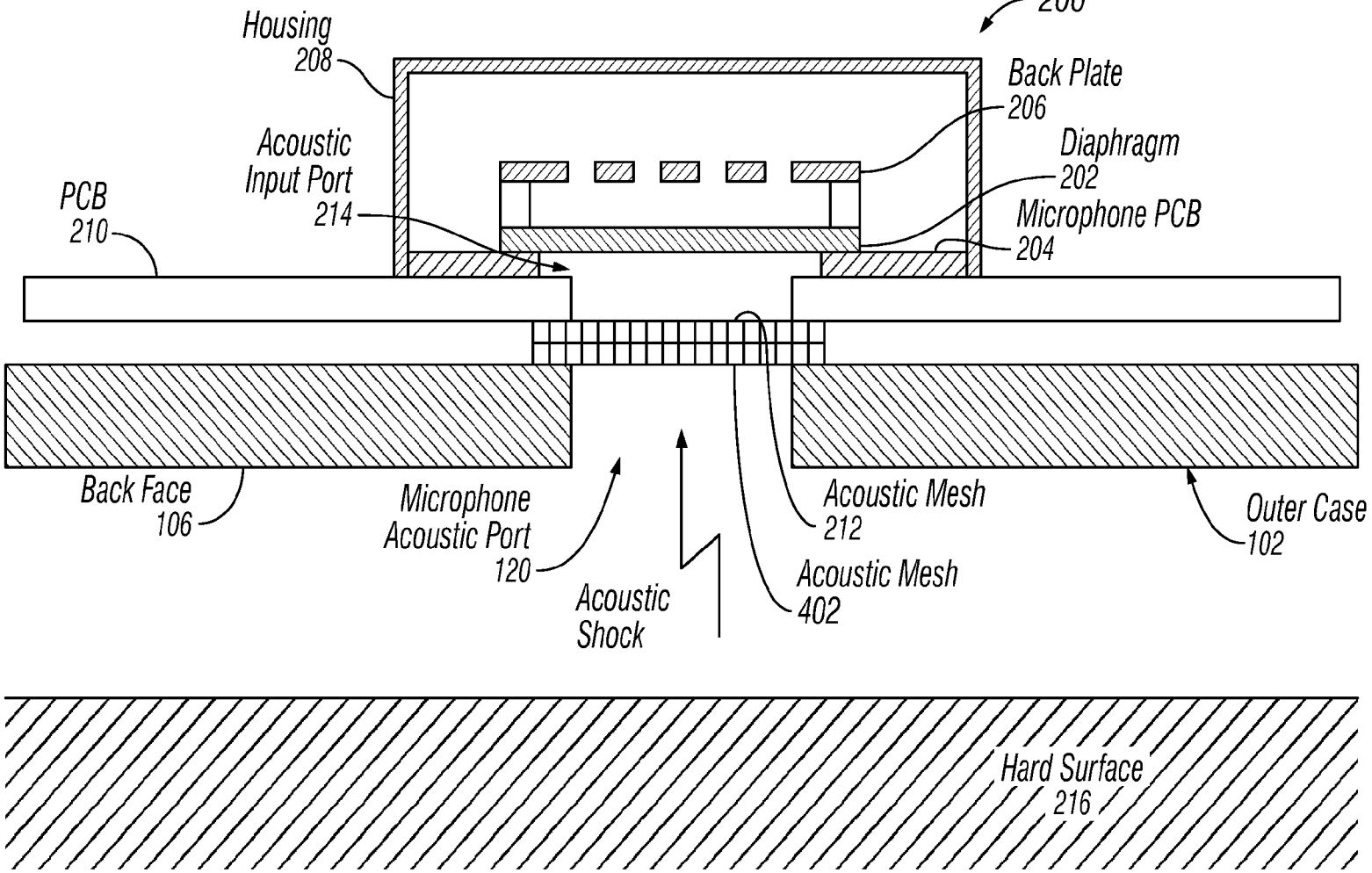
FIG. 4 illustrates a cross sectional side view of one embodiment of a microphone assembly having an acoustic mesh to protect against sudden acoustic shock.

FIG. 4 illustrates another embodiment of microphone 200 which is substantially similar to the microphone described in reference to FIG. 2, except in this embodiment, a second acoustic mesh 402 is positioned between diaphragm 202 and outer case 102. In one embodiment, similar to acoustic mesh 212, acoustic mesh 402 may be formed from a material having a non-linear acoustic response to an acoustic shock such as an air burst. In this aspect, acoustic mesh 402 may be substantially the same as acoustic mesh 212. In one embodiment, acoustic mesh 402 and acoustic mesh 212 are positioned one on top of the other with substantially no space in between. Double stacking of acoustic mesh 212 and acoustic mesh 402 in the manner described herein may increase the non-linear response of the materials to acoustic shock. In other words, the non-linear response of the two mesh layers together may be greater than the sum of the layers. Such enhancement may be particularly present when the two meshes are positioned directly on top of each other as illustrated in FIG. 4. Such placement may be achieved, for example, by adhering acoustic mesh 212 and acoustic mesh 402 together around their edges, chemically bonding the two together, or a press fit configuration. The bonded mesh layers may then be positioned between diaphragm 202 and outer case 102 to protect the diaphragm from an acoustic shock, such as that caused by dropping outer case 102 on hard surface 216 as illustrated.

Referring back to FIG. 1, further details of mobile communications device 100 that may have the microphone acoustic arrangement described above are now described. The device 100 may be, for example, a cellular telephone, a media player with wireless communications capabilities, a handheld input device, or a hybrid device (such as the iPhone® device) that combines several functions, including wireless telephony, web browsing, digital media player, and global positioning system, into the same handset unit. Examples of hybrid portable electronic devices include a cellular telephone that includes media player functionality, a gaming device that includes a wireless communications capability, a cellular telephone that includes game and email functions, and a portable device that receives email, supports mobile telephone calls, has music player functionality and supports web browsing. These are merely illustrative examples.

The outer case 102 may be formed of any suitable materials including, plastic, glass, ceramics, metal, or other suitable materials, or a combination of these materials. In some situations, the entire outer case 102 or portions of outer case 102 may be formed from a dielectric or other low-conductivity material, so that the operation of conductive antenna elements of the device 100 that are located within or in proximity to outer case 102 are not disrupted. Outer case 102 or portions of outer case 102 may also be formed from conductive materials such as metal. An illustrative housing material that may be used is anodized aluminum. Aluminum is relatively light in weight and, when anodized, has an attractive insulating and scratch-resistant surface. If desired, other metals can be used for the housing of device 100, such as stainless steel, magnesium, titanium, alloys of these metals and other metals, etc. In scenarios in which outer case 102 is formed from metal elements, one or more of the metal elements may be used as part of the antennas in device 100. For example, metal portions of outer case 102 may be shorted to an internal ground plane in device 100 to create a larger ground plane element for that device 100.

Display 128 may be a liquid crystal diode (LCD) display, an organic light emitting diode (OLED) display, or any other suitable display. The outermost surface of display 128 may be formed from one or more plastic or glass layers. If desired, touch screen functionality may be integrated into display 128 as previously discussed or may be provided using a separate touch pad device. An advantage of integrating a touch screen into display 128 to make display 128 touch sensitive is that this type of arrangement can save space and reduce visual clutter.

Display screen 128 (e.g., a touch screen) is merely one example of an input-output device that may be used with device 100. If desired, device 100 may have other input-output devices. For example, device 100 may have user input control devices such as button 126, and input-output components such as docking port 114 and one or more input-output jacks (e.g., for audio and/or video). A user of device 100 may supply input commands using user input interface devices such as button 126 and touch screen display 128. Suitable user input interface devices for electronic device 200 include buttons (e.g., alphanumeric keys, power on-off, power-on, power-off, and other specialized buttons, etc.), a touch pad, pointing stick, or other cursor control device, a microphone for supplying voice commands, or any other suitable interface for controlling device 100.

Although shown as being formed on the front face of device 100 in the example of FIG. 1A, buttons such as button 126 and other user input interface devices may generally be formed on any suitable portion of device 100. For example, a button such as button 126 or other user interface control may be formed on the side of device 100. Buttons and other user interface controls can also be located on the front face 104, back face 106, or other portion of device 100, such as side wall 108. If desired, device 100 can be controlled remotely (e.g., using an infrared remote control, a radio-frequency remote control such as a Bluetooth® remote control, etc.).

Device 100 may also have audio and video jacks that allow device 100 to interface with external components. Typical ports include power jacks to recharge a battery within device 100 or to operate device 100 from a direct current (DC) power supply, data ports to exchange data with external components such as a personal computer or peripheral, audio-visual jacks to drive headphones, a monitor, or other external audio-video equipment, a subscriber identity module (SIM) card port to authorize cellular telephone service, a memory card slot, etc. The functions of some or all of these devices and the internal circuitry of electronic device 100 can be controlled using input interface devices such as touch screen display 128.

Figure 5:
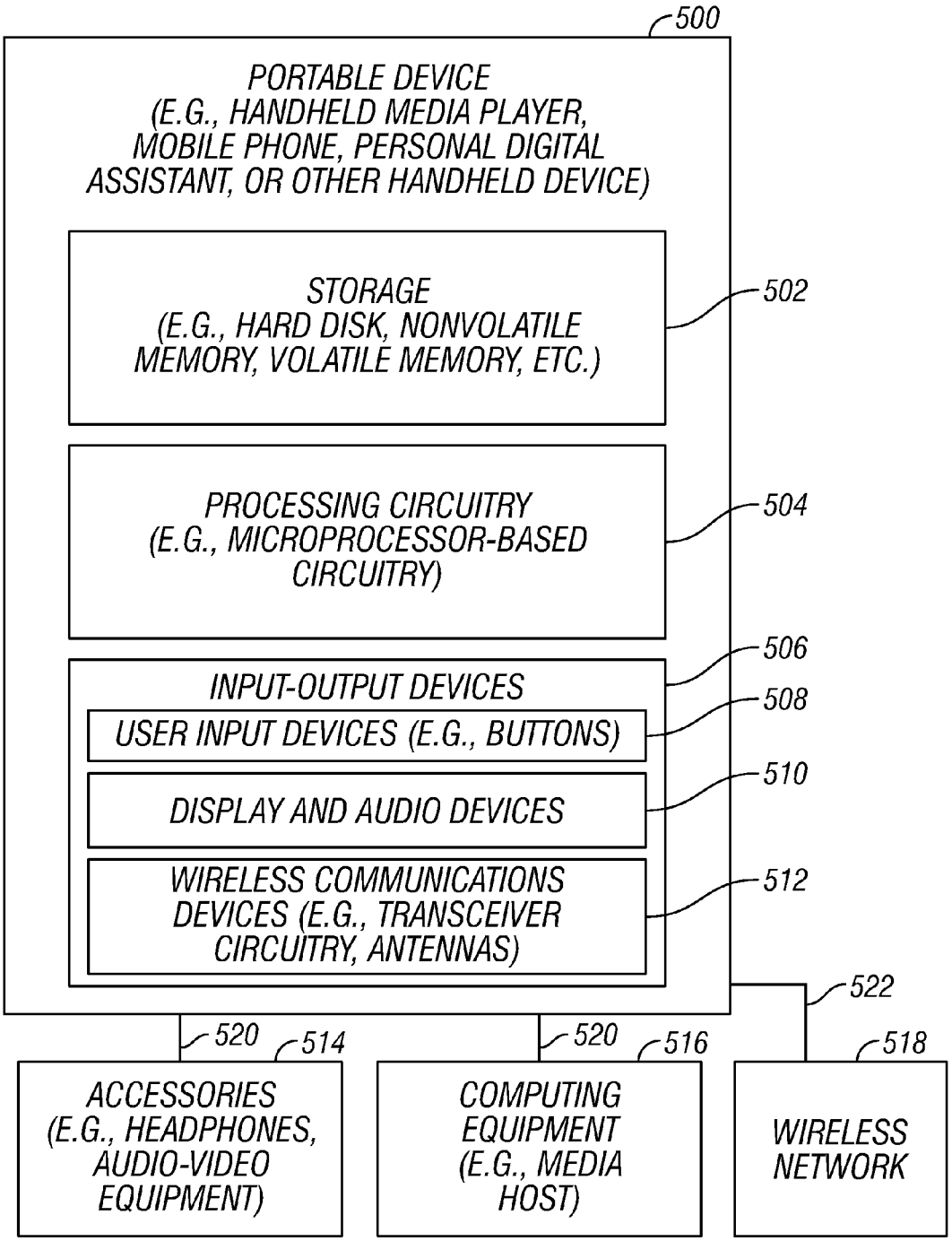
FIG. 5 illustrates a schematic diagram of one embodiment of a mobile communications device.

A schematic diagram of an embodiment of an illustrative portable electronic device such as a handheld electronic device is shown in FIG. 5. Portable device 500 may be a mobile telephone, a mobile telephone with media player capabilities, a handheld computer, a remote control, a game player, a global positioning system (GPS) device, a laptop computer, a tablet computer, an ultra-portable computer, a combination of such devices, or any other suitable portable electronic device.

As shown in FIG. 5, device 200 may include storage 502. Storage 502 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 504 may be used to control the operation of device 500. Processing circuitry 504 may be based on a processor such as a microprocessor and other suitable integrated circuits. With one suitable arrangement, processing circuitry 504 and storage 502 are used to run software on device 500, such as internet browsing applications, voice-over-internet-protocol (VoIP) telephone call applications, email applications, media playback applications, operating system functions, etc. Processing circuitry 504 and storage 502 may be used in implementing suitable communications protocols. Communications protocols that may be implemented using processing circuitry 504 and storage 502 include internet protocols, wireless local area network protocols (e.g., IEEE 802.11 protocols—sometimes referred to as Wi-Fi®), protocols for other short-range wireless communications links such as the Bluetooth® protocol, protocols for handling 3G or 4G communications services (e.g., using wide band code division multiple access techniques), 2G cellular telephone communications protocols, etc.

To minimize power consumption, processing circuitry 504 may include power management circuitry to implement power management functions. For example, processing circuitry 504 may be used to adjust the gain settings of amplifiers (e.g., radio-frequency power amplifier circuitry) on device 500. Processing circuitry 504 may also be used to adjust the power supply voltages that are provided to portions of the circuitry on device 500. For example, higher direct-current (DC) power supply voltages may be supplied to active circuits and lower DC power supply voltages may be supplied to circuits that are less active or that are inactive. If desired, processing circuitry 504 may be used to implement a control scheme in which the power amplifier circuitry is adjusted to accommodate transmission power level requests received from a wireless network.

Input-output devices 508 may be used to allow data to be supplied to device 500 and to allow data to be provided from device 500 to external devices. Display screen 128, button 126, microphone acoustic ports 116, 118 and 120, speaker acoustic port 110, and docking port 114 are examples of input-output devices 508.

Input-output devices 508 can also include user input-output devices 506 such as buttons, touch screens, joysticks, click wheels, scrolling wheels, touch pads, key pads, keyboards, microphones, cameras, etc. A user can control the operation of device 500 by supplying commands through user input devices 506. Display and audio devices 510 may include liquid-crystal display (LCD) screens or other screens, light-emitting diodes (LEDs), and other components that present visual information and status data. Display and audio devices 510 may also include audio equipment such as speakers and other devices for creating sound. Display and audio devices 510 may contain audio-video interface equipment such as jacks and other connectors for external headphones and monitors.

Wireless communications devices 512 may include communications circuitry such as radio-frequency (RF) transceiver circuitry formed from one or more integrated circuits, power amplifier circuitry, passive RF components, antennas, and other circuitry for handling RF wireless signals. Wireless signals can also be sent using light (e.g., using infrared communications). Representatively, in the case of microphone acoustic ports 116, 118 and 120, one or more of microphone 200 associated with these ports may be in communication with an RF antenna for transmission of signals from microphone 200 to a far end user. Such a configuration is illustrated in more detail in FIG. 6.

Figure 6:
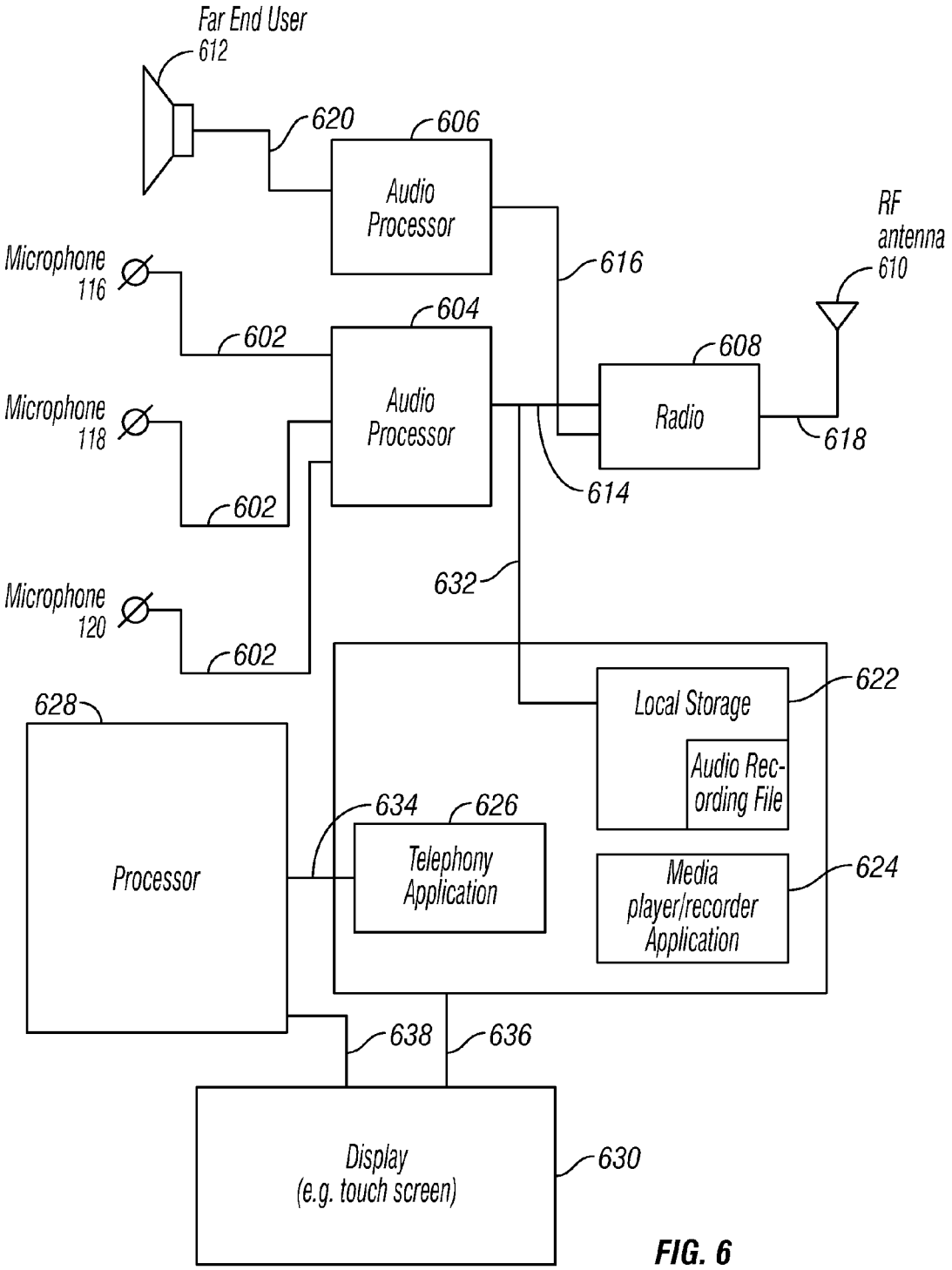
FIG. 6 illustrates a schematic diagram of one embodiment of a mobile communications device.

For example, FIG. 6 illustrates an embodiment in which each microphone 116, 118, 120 may be in communication with an audio processor 604 through paths 602. Paths 602 may include wired and wireless paths. Signals from microphones 116, 118, 120 may be transmitted through uplink audio signal path 614 to radio 608. Radio 608 may transmit the signals via downlink audio signal path 616 to audio processor 606, which is in communication with a far end user device 612 through path 620. Alternatively, radio 608 may transmit the signals to RF antenna 610 through path 618. Audio processor 604 may also be in communication with local storage 622, a media player/recorder application 624 or other telephony applications 626 on the device, through path 632, for local storage and/or recording of the audio signals as desired. Processor 628 may further be in communication with these local devices via path 634 and also display 630 via path 638 to facilitate processing and display of information corresponding to the audio signals to the user. Display 630 may also be in direction communication with local storage 622 and applications 624, 626 via path 636 as illustrated.

Returning to FIG. 5, device 500 can communicate with external devices such as accessories 514, computing equipment 516, and wireless network 518 as shown by paths 520 and 522. Paths 520 may include wired and wireless paths. Path 522 may be a wireless path. Accessories 514 may include headphones (e.g., a wireless cellular headset or audio headphones) and audio-video equipment (e.g., wireless speakers, a game controller, or other equipment that receives and plays audio and video content), a peripheral such as a wireless printer or camera, etc.

Computing equipment 516 may be any suitable computer. With one suitable arrangement, computing equipment 516 is a computer that has an associated wireless access point (router) or an internal or external wireless card that establishes a wireless connection with device 500. The computer may be a server (e.g., an internet server), a local area network computer with or without internet access, a user's own personal computer, a peer device (e.g., another portable electronic device 500), or any other suitable computing equipment.

Wireless network 518 may include any suitable network equipment, such as cellular telephone base stations, cellular towers, wireless data networks, computers associated with wireless networks, etc. For example, wireless network 518 may include network management equipment that monitors the wireless signal strength of the wireless handsets (cellular telephones, handheld computing devices, etc.) that are in communication with network 518.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, the acoustic mesh and/or protective layer may be positioned over any port formed in a substantially planar face of the device. For example, the acoustic mesh may be positioned over a speaker or receiver acoustic port to protect a transducer (e.g. an electric-to-acoustic transducer such as a speaker or receiver) that may receive a rapid air burst through the port. In addition, the acoustic mesh may be used to cover a transducer associated port in any type of personal portable electronic device. For example, the acoustic mesh may be used in connection with the mobile communications described herein as well as a tablet computer, personal computer, laptop computer, notebook computer and the like. The description is thus to be regarded as illustrative instead of limiting.

What is claimed is:

1. A portable electronic device comprising:

an outer case having a substantially planar face in which a microphone associated acoustic port is formed;

a micro-electro-mechanical system (MEMS) microphone positioned within the outer case, the MEMS microphone having a diaphragm facing the microphone associated acoustic port; and a closed mesh positioned between the substantially planar face of the outer case and the diaphragm, the closed mesh having a non-linear acoustic resistance that is to reduce an effect of an incoming air burst on the diaphragm.

2. The portable electronic device of claim 1 wherein the acoustic resistance of the closed mesh is at least 1000 MKS rayls.

3. The portable electronic device of claim 1 wherein the microphone associated acoustic port is dimensioned to tune an absolute acoustic resistance of the closed mesh.

4. The portable electronic device of claim 1 wherein the closed mesh is a first acoustic mesh, the device further comprising:

a second acoustic mesh positioned over the microphone associated acoustic port.

5. The portable electronic device of claim 3 wherein the absolute acoustic resistance is from 600 MKS rayls to 2000 MKS rayls.

6. The portable electronic device of claim 1 wherein the device is a mobile telephone.

7. A portable electronic device comprising:

an outer case having a substantially planar face in which an acoustic port is formed;

a transducer positioned within the outer case, the transducer having a diaphragm facing the acoustic port; and an acoustic mesh positioned over the acoustic port, the acoustic mesh comprising a closed mesh material having an acoustic resistance that is to a) reduce an effect of an incoming air burst on the transducer in a non-linear manner and b) present a linear acoustic resistance to speech by a user of the device.

8. The portable electronic device of claim 7 wherein the transducer is a MEMS microphone.

9. The portable electronic device of claim 7 wherein the acoustic port is an acoustic input port and the planar face is a back face of the outer case.

10. The portable electronic device of claim 7 wherein the acoustic mesh is positioned between the diaphragm and the substantially planar face of the outer case.

11. The portable electronic device of claim 7 wherein the closed mesh material comprises substantially no calculable mesh openings on a face of the material.

12. The portable electronic device of claim 7 wherein the acoustic resistance of the acoustic mesh is from 1000 rayls to 5000 rayls.

13. The portable electronic device of claim 7 wherein the acoustic port is dimensioned to tune an absolute acoustic resistance of the acoustic mesh.

14. The portable electronic device of claim 7 wherein the acoustic mesh reduces the effect of the incoming air burst on the diaphragm by causing a greater degree of pressure drop across the acoustic mesh in response to the incoming air burst than non-air burst incoming air.

15. A portable electronic device comprising:

a means for communicating with a far end user, the means for communicating having a means for receiving an incoming sound wave;

a means for converting the sound wave into an electrical signal, the means for converting acoustically coupled to the means for receiving; and a means for protecting the means for converting from an incoming air burst in a non-linear manner by causing a greater pressure drop in response to the incoming air burst than non-air burst incoming air, wherein the means for protecting comprises a material having substantially no calculable openings on a face of the material.

16. The portable electronic device of claim 15 wherein the means for protecting is one of a closed mesh material or a membrane.

17. A microphone assembly comprising:

a transducer for converting acoustic energy into electrical energy, the transducer having a pressure sensitive diaphragm which vibrates in response to the acoustic energy;

a housing for receiving the transducer therein, the housing having an acoustic input opening for directing the acoustic energy to the diaphragm; and a closed mesh positioned over the acoustic input opening, the closed mesh having a non-linear acoustic resistance so as to reduce an effect of an incoming air burst on the diaphragm by causing a greater pressure drop across the closed mesh in response to an incoming air burst than a non-air burst.

18. The microphone assembly of claim 17 wherein the transducer is a MEMS microphone.

19. The microphone assembly of claim 17 wherein the closed mesh has an acoustic resistance of at least 1000 rayls.

* * * * *